US012359675B2

(12) United States Patent
Janjic et al.

(10) Patent No.: US 12,359,675 B2
(45) Date of Patent: Jul. 15, 2025

(54) BLADE ARRANGEMENT HAVING MICROBLADES

(71) Applicant: KSB SE & Co. KGaA, Frankenthal (DE)

(72) Inventors: Boris Janjic, Frankenthal (DE); Sebastian Lang, Frankenthal (DE)

(73) Assignee: KSB SE & Co. KGaA, Frankenthal (DE)

( * ) Notice: Subject to any disclaimer, the term of this patent is extended or adjusted under 35 U.S.C. 154(b) by 0 days.

(21) Appl. No.: 18/580,238

(22) PCT Filed: Jul. 14, 2022

(86) PCT No.: PCT/EP2022/069793

§ 371 (c)(1),
(2) Date: Jan. 18, 2024

(87) PCT Pub. No.: WO2023/001699

PCT Pub. Date: Jan. 26, 2023

(65) Prior Publication Data

US 2024/0328428 A1 Oct. 3, 2024

(30) Foreign Application Priority Data

Jul. 19, 2021 (DE) ..... 10 2021 118 564.5

(51) Int. Cl.
*F04D 29/24* (2006.01)
*F04D 29/22* (2006.01)

(52) U.S. Cl.
CPC ..... *F04D 29/242* (2013.01); *F04D 29/2222* (2013.01)

(58) Field of Classification Search
CPC ..... F04D 29/242; F04D 29/2222
See application file for complete search history.

(56) References Cited

U.S. PATENT DOCUMENTS 2,753,808 A * 7/1956 Kluge ..... F01D 5/145 416/91
3,221,662 A 12/1965 White
9,777,741 B2 * 10/2017 Marsis ..... F04D 29/2288
2014/0064970 A1 3/2014 Springer
2016/0146214 A1 5/2016 Marsis
(Continued)

FOREIGN PATENT DOCUMENTS

CN 112360806 A 2/2021
DE 10 2006 021 925 A1 12/2007
(Continued)

OTHER PUBLICATIONS

International Search Report (PCT/ISA/210) issued in PCT Application No. PCT/EP2022/069793 dated Oct. 20, 2022 with English translation (6 pages).
(Continued)

*Primary Examiner* — Sabbir Hasan
(74) *Attorney, Agent, or Firm* — Crowell & Moring LLP

(57) ABSTRACT

A centrifugal pump includes a blade arrangement. The blade arrangement has a carrier unit on which blades are arranged. The blades are subdivided into segments. The carrier unit is divided into annular portions which adjoin one another radially. Segments are arranged offset from one another in the annular portions.

2 Claims, 7 Drawing Sheets

(56) References Cited

U.S. PATENT DOCUMENTS

| | | | |
|---|---|---|---|
| 2018/0187692 | A1 | 7/2018 | Christ et al. |
| 2018/0209447 | A1 | 7/2018 | Springer |

FOREIGN PATENT DOCUMENTS

| | | | |
|---|---|---|---|
| DE | 10 2011 007 907 | B3 | 6/2012 |
| DE | 10 2015 212 203 | A1 | 1/2017 |
| DE | 10 2015 213 451 | A1 | 1/2017 |
| DE | 20 2019 004 403 | U1 | 1/2020 |
| SU | 653428 | A1 | 3/1979 |

OTHER PUBLICATIONS

German-language Written Opinion (PCT/ISA/237) issued in PCT Application No. PCT/EP2022/069793 dated Oct. 20, 2022 with English translation (9 pages).

German-language Search Report issued in German Application No. 10 2021 118 564.5 dated Aug. 18, 2022 with partial English translation (11 pages).

* cited by examiner

BLADE ARRANGEMENT HAVING MICROBLADES

CROSS REFERENCE TO RELATED APPLICATION

This application claims priority under 35 U.S.C. § 119 from German Patent Application No. 102021118564.5, filed Jul. 19, 2021, the entire disclosure of which is herein expressly incorporated by reference.

BACKGROUND

The disclosure relates to a centrifugal pump having a blade arrangement, wherein the blade arrangement has a carrier unit, on which blades are arranged.

A central component of a centrifugal pump is the impeller, which transmits the mechanical energy as momentum to the fluid to be pumped. The shape of the impeller determines how the flow exits the pump. In terms of the design of the impeller, a distinction is made between closed, semi-open and open forms or forms with and without a cover shroud and rear shroud. In the case of a closed impeller, the impeller blades are connected to a respective shroud on both sides. The impellers may be classified into different impeller forms according to the progression of the streamlines in the impeller. A distinction is made between a radial impeller, semi-axial impeller, axial impeller and peripheral impeller.

Centrifugal pumps often also have guide devices. Guide devices usually have guide blades and form guide channels for the pumping medium between two guide blades. Such guide devices may be designed as diffusers. Pumping medium exiting the impeller enters the guide device. In the guide device, kinetic energy is converted into pressure energy. A deflection of the medium furthermore takes place. The vortex is possibly reduced for inflow into a subsequent impeller.

The blades of a centrifugal pump are connected to the impeller in a fixed or adjustable manner and represent the most important structural elements for converting mechanical power into pump power or for transforming velocity energy into and pressure energy.

In the flow direction, the blade is delimited by the leading edge, which is also referred to as the suction edge, and by the trailing edge, which is typically referred to as the pressure edge; transversely to the flow direction, the blade is delimited by the hub or by the inner cover shroud on the inside and by the pump casing or the outer cover shroud on the outside.

Since there is no normal component of relative velocity perpendicular to the blade in impellers, the blade surfaces represent flow surfaces consisting of streamlines which are infinitely close to one another.

The velocity triangles on a streamline at the blade inlet and blade outlet substantially define the shape of the blades, taking into account the blade thickness. The progression of the blade center line between the blade inlet and blade outlet is referred to as the median line. It is very often described by a circular arc, but also by a parabolic arc, an S-shape and other analytical curves.

As a general rule, the blade inlet is designed to provide shock-free entry with a vortex-free inflow. The blade angle at the outlet is more or less steep, depending-among other things-on the pumping head to be achieved. In blades of radial impellers, it is generally less than 90°. In this case, the blade is referred to as backward curved. The radially ending blade is characterized by a blade angle of 90° and the forward curved blade is characterized by a blade angle of greater than 90°.

The minimum blade thickness is approximately 3 mm for cast iron, 4 mm for cast steel and, in special cases, such as inserted or welded-on sheet steel blades, even thinner blade thicknesses can also be realized.

The design of the blades and the blade shape is the subject of constant research and development. In this regard, DE 10 2015 212 203 A1 describes an impeller for a centrifugal pump, whereof the blades are arranged in bundles. An increase in the pump capacity is achieved, whilst ensuring a large free passage.

DE 10 2015 213 451 describes profile shapes, which are produced by the superimposition of the characteristic median line with a negative blade inlet angle together with a thickness distribution or a drop-shaped profile. An evenly distributed load on the blade flanks is thus achieved.

DE 10 2011 007 907 B3 also describes a blade contour, which is subject to an even load due to its contour. This is achieved by a highly curved blade contour, which begins at an angle of smaller than 0°.

The demonstrated examples generally solve problem areas in hitherto existing impellers for centrifugal pumps. Such developments are firstly expensive and only achieve the desired profitability in cases of mass production. A solution for individual applications, in particular the optimization of individual pump hydraulics, is difficult to envisage on a large scale.

SUMMARY

One of the objects of the disclosure is to specify a centrifugal pump with optimized flow control. Individual and customer-orientated configuration of the impeller should be possible here. Simple and cost-effective production of the impeller should moreover be possible. In addition, it should be possible to mount the impeller in as simple a manner as possible and to easily recycle it after use.

This and other objects are achieved according to the disclosure by centrifugal pump having a blade arrangement disclosed herein. Preferred variants are to be found in the description and the drawings.

According to the disclosure, the blades are subdivided into segments and the carrier unit is divided into annular portions which adjoin one another radially. The segments in the annular portions are arranged offset from one another here. According to the disclosure, the segments may therefore be formed as microblades. By replacing few macroblades with many microblades in conjunction with preferably forming the microblades in a generative process on conventionally manufactured carrier units of impellers or guide devices, it is possible to realize a blade arrangement with individually adapted pump hydraulics in an efficient and economical manner.

Broadly speaking, a blade arrangement is understood to be an arrangement for energy transfer or for energy conversion in flow machines such as a centrifugal pump. In this regard, a blade arrangement may be designed as a guide device and/or as an impeller. Such a guide device and/or such an impeller is divided into annular portions which adjoin one another radially, wherein segments are arranged on the annular portions. These segments are ideally designed as microblades.

According to the disclosure, the segments are arranged offset from one another. In an advantageous variant of the disclosure, the segments here are arranged offset from one another in the circumferential direction, so that the fluid to be pumped flows radially from segment to segment and is subject to momentum transfer.

In an alternative variant of the disclosure, the segmented blades are interrupted merely by gaps. Depending on the results of computer-aided flow optimization, the segments may be distributed in quite different ways, in particular arranged symmetrically or asymmetrically, and designed to have the same length and curvature or to be the same or totally individual in terms of their length and curvature.

For better structuring, a carrier unit is divided into more than two, preferably more than three, in particular more than four, annular portions and/or fewer than ten, preferably fewer than eight, in particular fewer than six annular portions.

By dividing the carrier unit into annular portions, the optimum arrangement of the segments, which are preferably formed by a generative process on a carrier unit, can be easily implemented in a computer-aided manner. To this end, the annulus width is designed to be the same or different for all annular portions, depending on the individual optimization of the pump hydraulics.

According to the disclosure, the annulus width is more than 5%, preferably more than 10%, in particular more than 15%, and/or less than 45%, preferably less than 40%, in particular less than 30%, of the carrier unit radius. As a result, depending on the size of the impeller or guide device and the individual design of the pump hydraulics, the segments can be ideally positioned and configured using annular portions.

The segments are preferably arranged within an annular portion. The segments may extend over the entire annulus width of an annular portion here or be arranged within an annular portion at a spacing from the adjacent annular portions.

Alternatively, the segments may also extend such that they overlap at least two annular portions. Depending on the size or length of a segment, the segment length extends up to 50% over two annular portions in each case.

According to the disclosure, depending on their arrangement on the annular portions, the segments are designed as middle segments and/or suction-edge segments and/or pressure-edge segments. In particular, the shape of the segments, the angle of curvature, the length, the height and the thickness may be individually adapted according to the determined load situation in each case. Ideally, the segments may be designed individually depending on their assignation to an annular portion. It is furthermore conceivable that each individual segment is individually adapted and optimized according to the flow situation.

The segments are preferably aligned in the meridian direction on the carrier unit. The segments may be arranged in a row and/or offset from one another here. Ideally, the segments have a linear shape and/or a shape which curves radially outwards. All segments may have a similar curvature here, or a similar curvature within one annular portion, or they may be designed with the same alignment within one annular portion or they may be designed in quite different ways depending on the individual configuration of the pump hydraulics.

In a particularly advantageous variant of the disclosure, the segments are designed as microblades. As a result, the momentum transfer to the fluid and the transfer of mechanical power can be realized in a particularly efficient manner.

According to the disclosure, the segments have a length of more than 5%, preferably more than 10%, in particular more than 15% and/or a length of less than 50%, preferably less than 45%, in particular less than 35%, of the carrier unit radius. As a result of the short design, the segments achieve the form of microblades in a particularly ideal manner. The carrier unit preferably has more than 10, preferably more than 15, in particular more than 20, segments. By replacing few macroblades with many small microblades which are individually adapted according to the respective pump hydraulics, it is possible to create a particularly optimized centrifugal pump for the respective application.

According to the disclosure, generatively produced segments are applied to a conventionally manufactured carrier unit of a blade arrangement. This may refer to an open impeller. A closed impeller is likewise conceivable according to the disclosure. In this case, the carrier unit with the segments arranged thereon has a cover shroud. Moreover, the blade arrangement with the segments may also be designed as a guide device, preferably as a diffuser.

The carrier unit is preferably formed in one piece with the segments and/or—in the case of a closed blade arrangement—with the cover shroud. The carrier unit and/or the cover shroud may be conventionally manufactured as cast parts, for example. Using a generative process, the segments may be applied to the carrier unit, whereby a one-piece component of a centrifugal pump is produced. In an alternative variant of the disclosure, the blade arrangement may also be produced entirely as a cast part.

According to the disclosure, the blade arrangement may be manufactured in an innovative process by means of an integrative manufacturing unit. The carrier unit and/or the cover shroud here is conventionally manufactured using a primary shaping and/or cutting process. Depending on the particular application and the hydraulic requirements, the optimum design and arrangement of the blades in the form of small segments, in particular as microblades, is determined using computer-aided simulation. The result of the simulation is a 3D-CAD data set of the blade arrangement, whereby the integrative manufacturing unit arranges the segments precisely on the carrier unit using generative design.

The term generative design covers all manufacturing processes in which material is applied layer by layer and three-dimensional components are thereby produced. The layered construction is realized in a computer-controlled manner using one or more liquid or solid materials according to predefined dimensions and shapes. Physical or chemical hardening or melting processes take place during construction. Typical materials for 3D printing are plastic materials, synthetic resins, ceramics, metals, carbon and graphite materials.

Generative or additive manufacturing processes are understood to mean processes in which material is applied layer by layer to produce a three-dimensional component. According to the disclosure, the segments are formed in a generative manufacturing process. Selective laser melting and cladding, also known as buildup welding, are used to form the segments. An applicable process in an alternative variant of the disclosure is also cold gas spraying and extrusion in conjunction with the application of a meltable plastic material.

Generatively produced segments advantageously have a particularly sophisticated and thin-walled design. Fine segments, which are flow-optimized via CFD, transfer the momentum to the fluid virtually without loss and in a particularly efficient manner. The complex structure of the segments prevents eddy formations and flow separations and is notable for a low component mass.

In selective laser melting, the segments are produced according to a process in which a layer of a buildup material is firstly applied to a base. The buildup material for producing the segments is preferably made of metal powder particles. In a variant of the disclosure, iron-containing and/or cobalt-containing powder particles are used for this. These may contain additives such as chromium, molybdenum or nickel. The metal buildup material is applied to a plate in a thin layer in powder form. Radiation is then used to completely melt the powder material locally at the required points in each case and, after the solidification, a solid material layer is formed. The base is then lowered by the amount of one layer thickness and powder is applied again. This cycle is repeated until all layers have been melted on and the finished segments are produced. According to the disclosure, this produces blade contours which are designed to be particularly sophisticated and flow-optimized.

A laser beam which generates the segments from the individual power layers may be used as radiation, for example. The data for directing the laser beam are software-generated based on a 3D-CAD body. An electron beam (EB) may be used as an alternative to selective laser melting.

In buildup welding or cladding, the segments are produced according to a process which coats a base structure by welding. The buildup welding here builds up a volume using a filler metal in the form of a wire or a powder, which achieves a particularly sophisticated and flow-optimized shape of the segments.

The rear and/or cover shroud may be produced by primary shaping or a subtractive manufacturing process. Primary shaping is a main group of manufacturing processes, in which a solid body, which has a geometrically defined shape, is produced from an amorphous material. Primary shaping is used to produce the initial shape of a solid body and to create the material cohesion. In a primary shaping process, blanks made of plastically deformable materials are specifically made into a different shape without removing material from the blanks. In subtractive manufacturing processes, material is removed from the workpiece. Chips are predominantly produced in addition to the generated component. The cover shroud is preferably produced from a casting material.

In a particularly preferred variant, a segment is produced in a flow-optimized manner and multiples thereof are arranged on the carrier unit according to the optimum pump hydraulics.

Regardless of the previous description, the disclosure is not restricted to single-stage centrifugal pumps, but also extends, in particular, to multi-stage centrifugal pumps. The impeller according to the disclosure or the guide device according to the disclosure is notable for being particularly flexible, since segments which are arranged in an individually optimized manner for each pump stage may be formed on any conventionally manufactured carrier unit.

Further features and advantages of the disclosure can be found in the description of exemplary embodiments with reference to the drawings and in the drawings themselves, in which:

DETAILED DESCRIPTION

Figure 1:
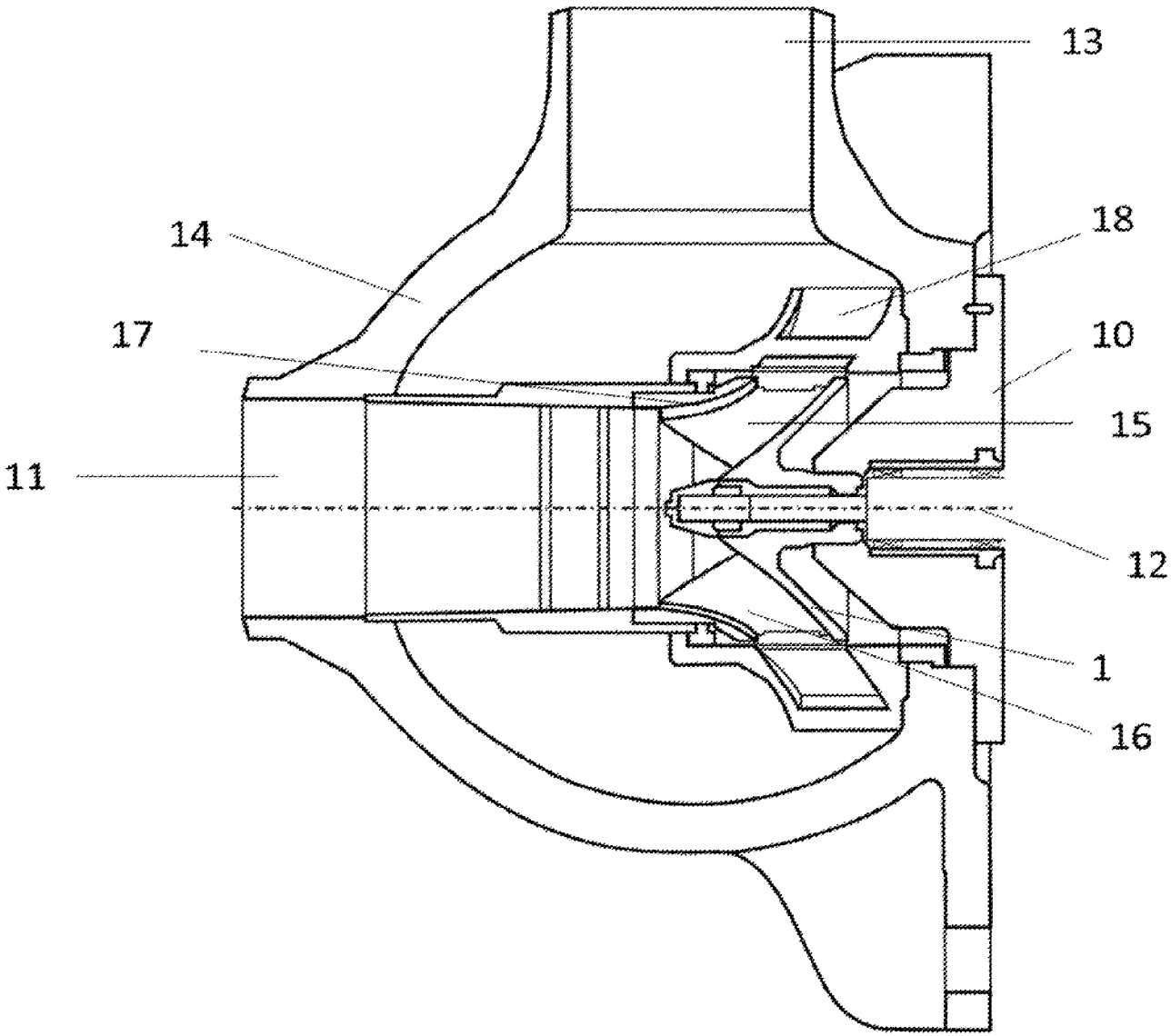
FIG. 1 shows a sectional illustration of a centrifugal pump with a spherical casing.

FIG. 1 shows, by way of example, a sectional illustration through a centrifugal pump with a spherical casing 14. The medium flows into the centrifugal pump via the suction port 11, is acted upon by kinetic energy via an impeller 15, which is connected to the shaft 12 in a rotationally fixed manner, and exits the pump casing via the pressure nozzle 13. The bearing carrier cover 10 closes the pump chamber in the direction of the drive.

The impeller 15 has a carrier unit 1, which is occupied by blades. The carrier unit 1 is formed in one piece with the blades and the cover shroud 17 and is designed as a closed impeller 15. A guide device 18 is positioned around the impeller 15, which guide device collects the discharge from the impeller 15 and converts the kinetic energy into pressure energy.

Figure 2:
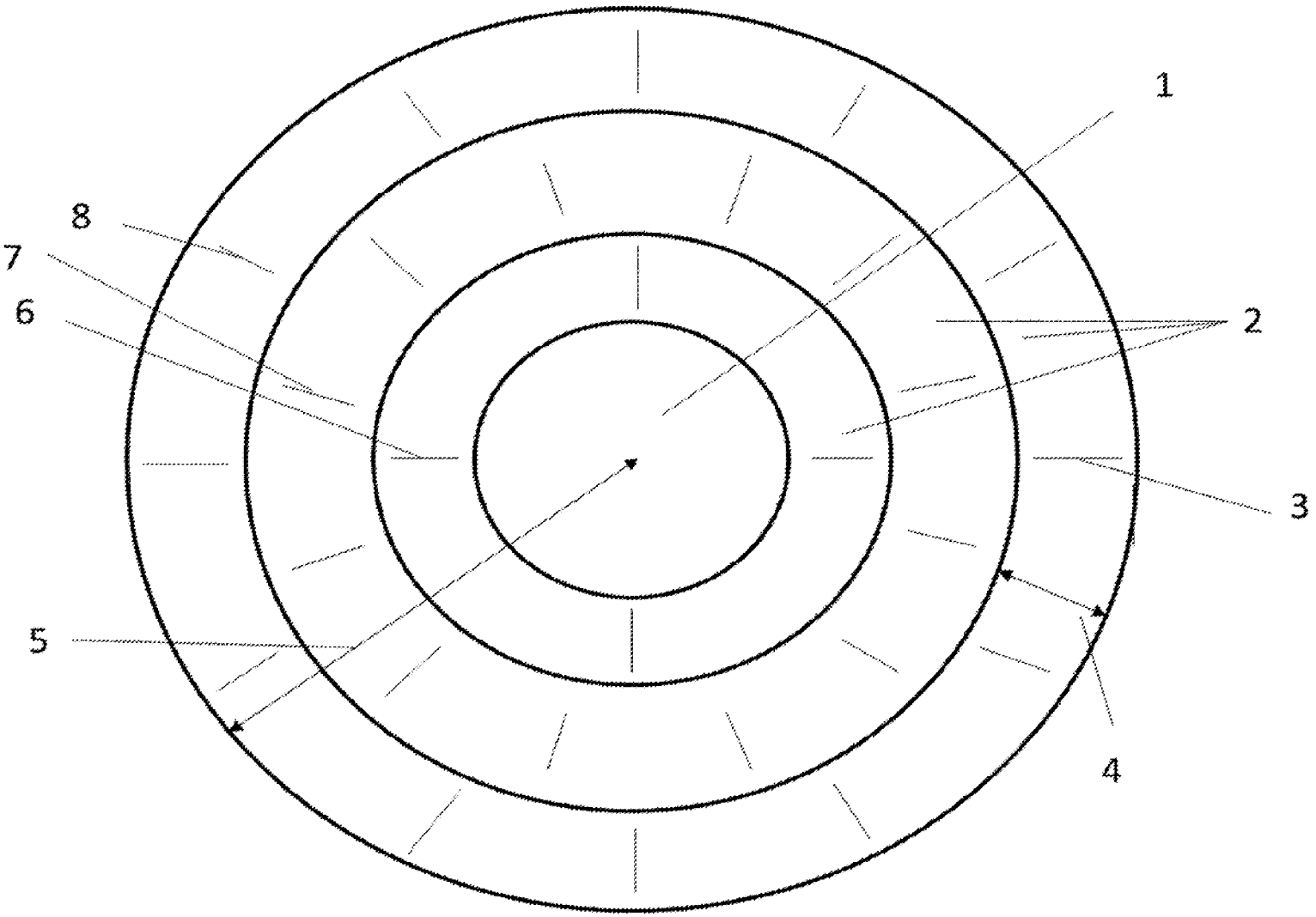
FIG. 2 shows a plan view of a blade arrangement with a carrier unit and segments.

FIG. 2 shows the carrier unit 1 of a blade arrangement in the form of an impeller for a centrifugal pump with the carrier unit radius 5. The carrier unit 1 is subdivided into three annular portions 2, which each directly adjoin one another. All annular portions 2 have the same annulus width 4. Linear segments 3 are arranged within an annular portion 2 and are arranged offset from one another from annular portion to annular portion 2.

In a variant of the disclosure, the contour of the segments 3 is adapted according to the positioning on the annular portions 2. In this regard, the segment 3 on the innermost annular portion 2 is designed as a suction edge segment 6, the segment 3 on the middle annular portion 2 is designed as a middle edge segment 7 and the segment 3 on the outer annular portion 2 is designed as a pressure edge segment 8.

Figure 3:
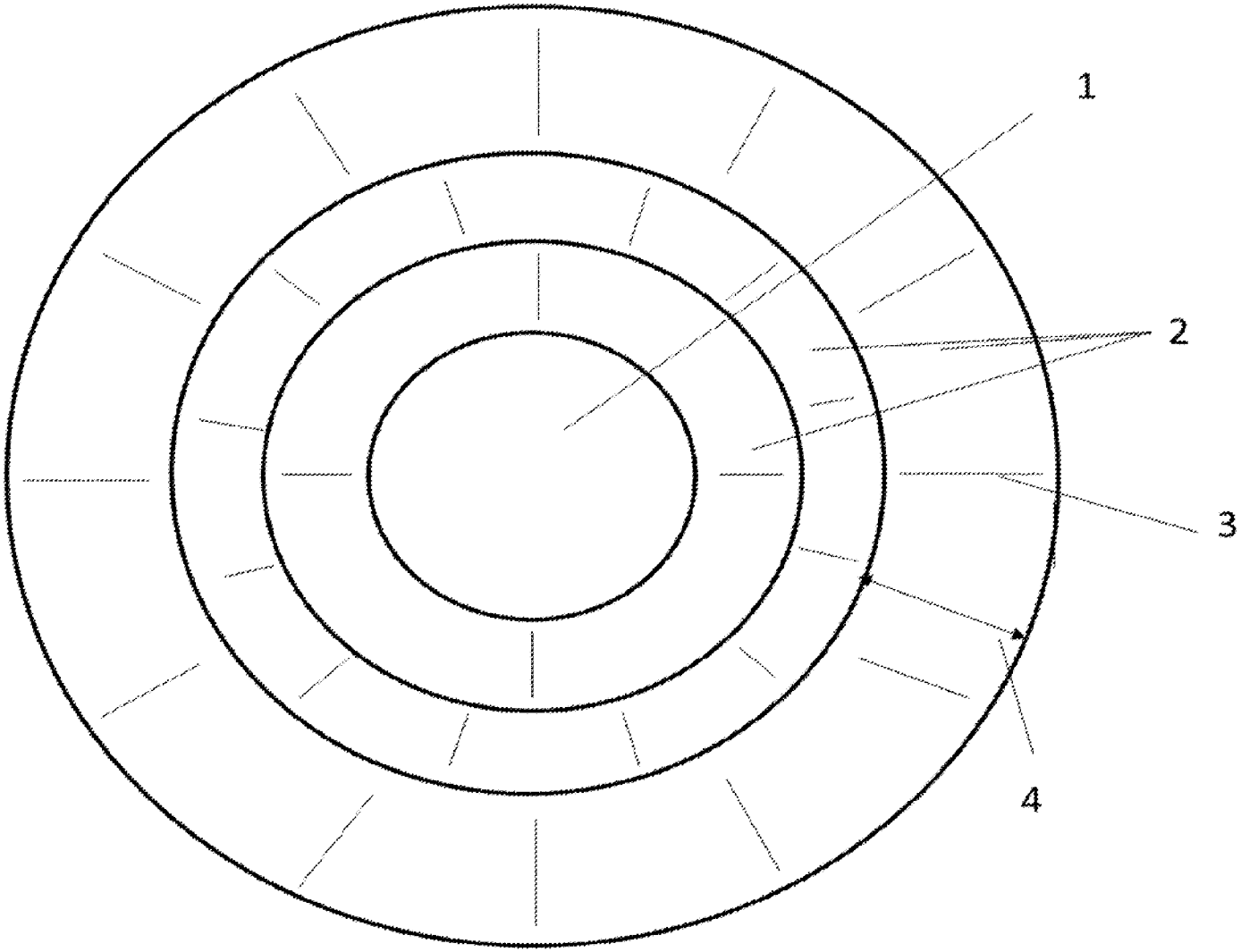
FIG. 3 shows a plan view of a blade arrangement with different annular portions and segments.

FIG. 3 shows a carrier unit 1 of a blade arrangement in the form of an impeller for centrifugal pumps having annular portions 2 which have a different annulus width 4. The segments 3 are arranged centrally within the annular portions 2, wherein the length of the segments 3 is adapted according to the respective annulus width 4. The segments 3 are arranged offset from one another depending on their position on an annular portion 2.

Figure 4:
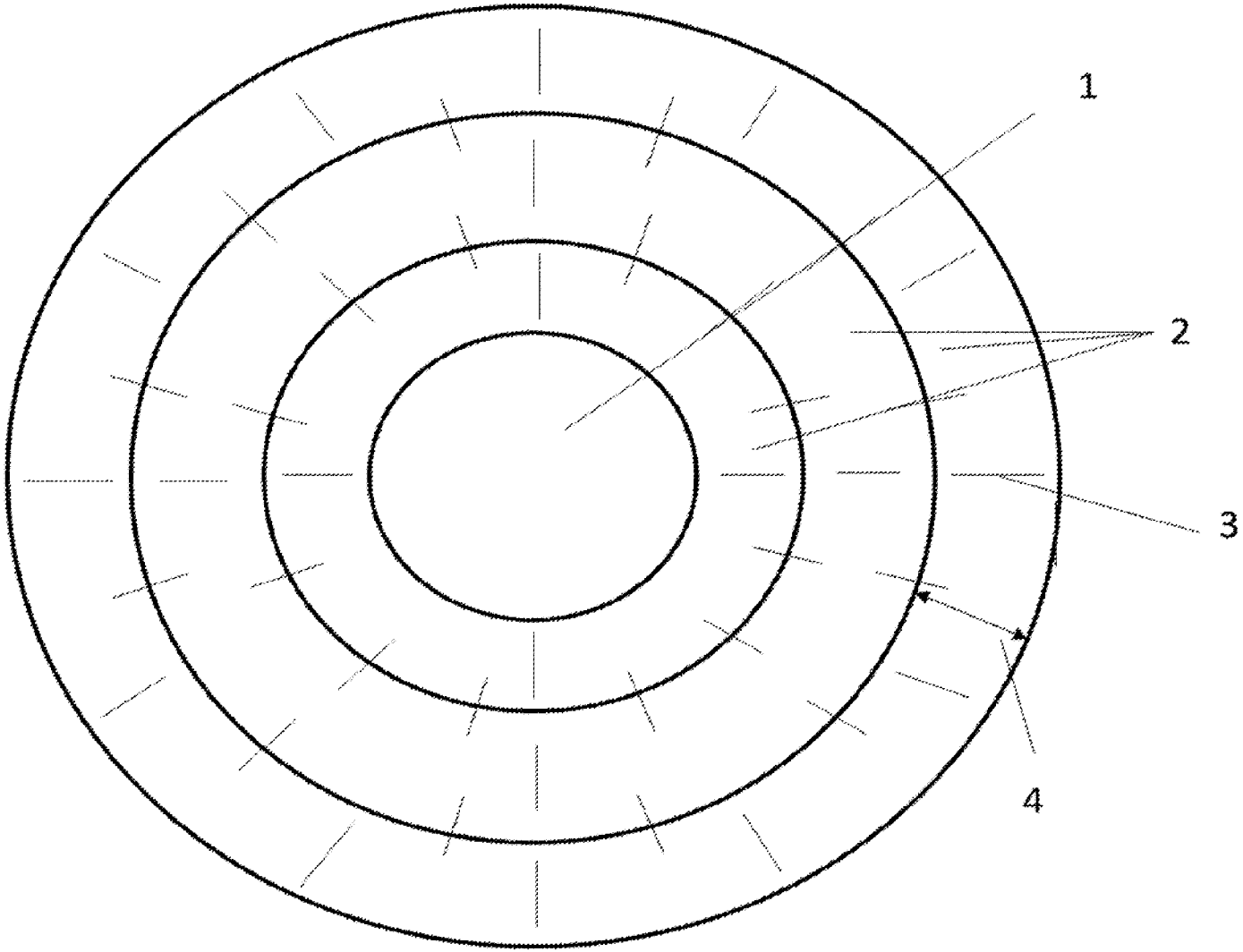
FIG. 4 shows a plan view of a blade arrangement with segments which overlap annular portions.

FIG. 4 shows a carrier unit 1 having annular portions 2 with the same annulus width 4. The segments 3 are arranged both within an annular portion 2 and also such that they overlap annular portions. The segments 3 are both offset from one another and positioned on the carrier unit 1 on a non-continuous line.

Figure 5:
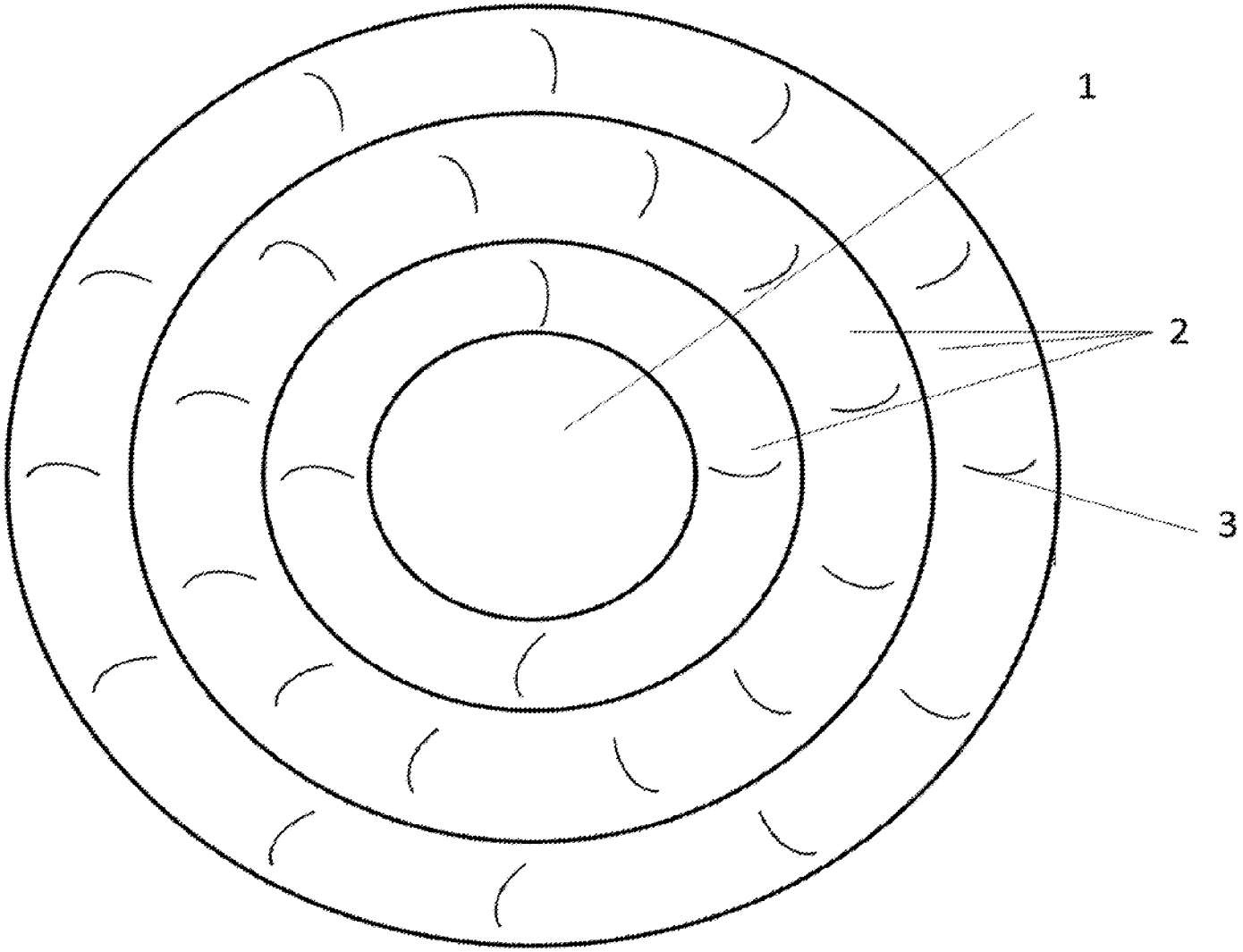
FIG. 5 shows a plan view of a blade arrangement with radially curved segments.

FIG. 5 shows a carrier unit 1 having radially curved segments 3. The segments 3 are arranged within an annular portion 2, wherein the spacings from the annulus ends of the annular portion 2 is designed to be the same for all segments 3. The segments 3 are arranged in the meridian direction on the carrier unit 1.

Figure 6:
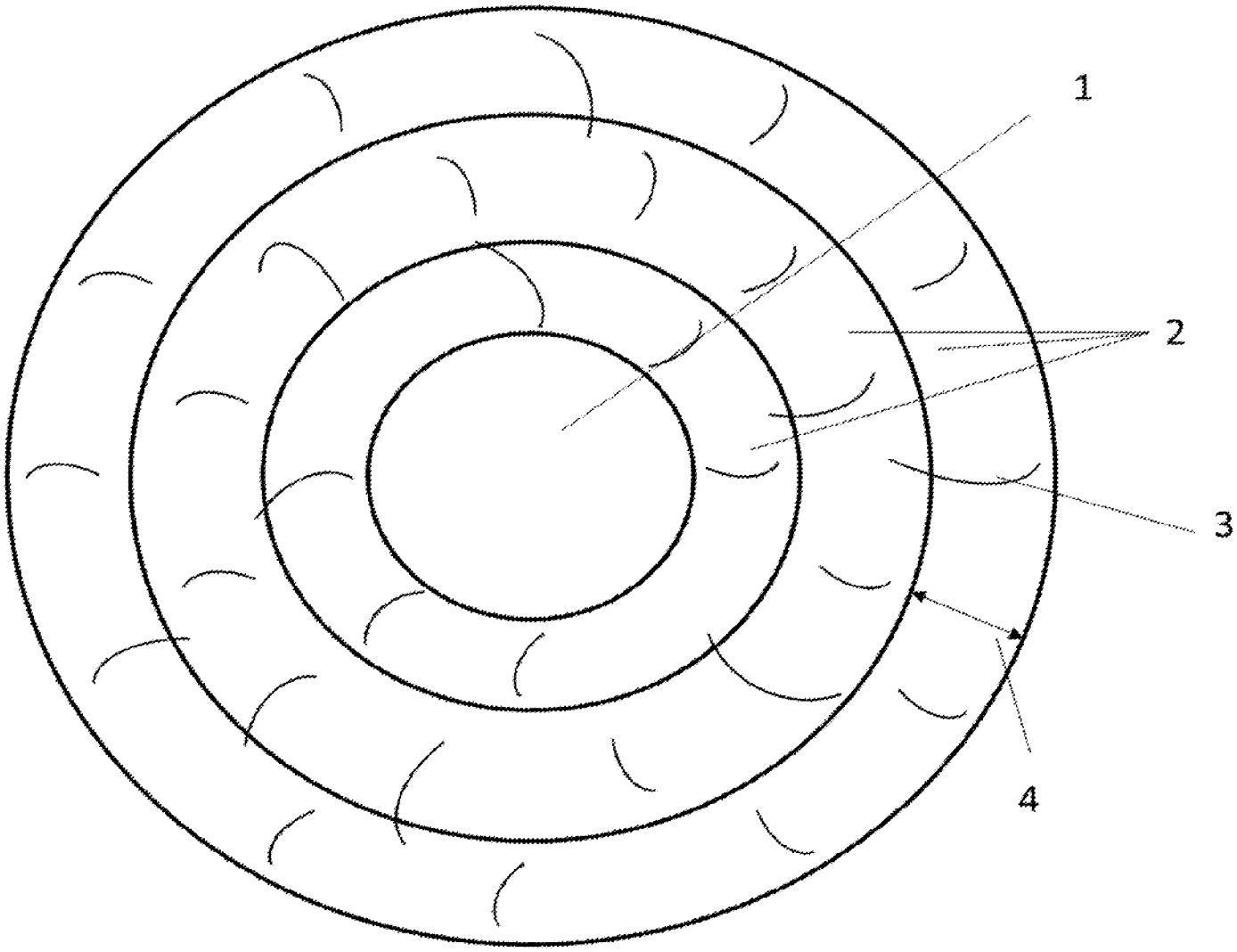
FIG. 6 shows a plan view of a blade arrangement with radially curved segments of different length.

FIG. 6 shows a carrier unit having radially curved segments 3, which partially overlap the annular portions 2. The curvature of the segments 3 here is individually adapted according to the respective annular portion 2.

Figure 7:
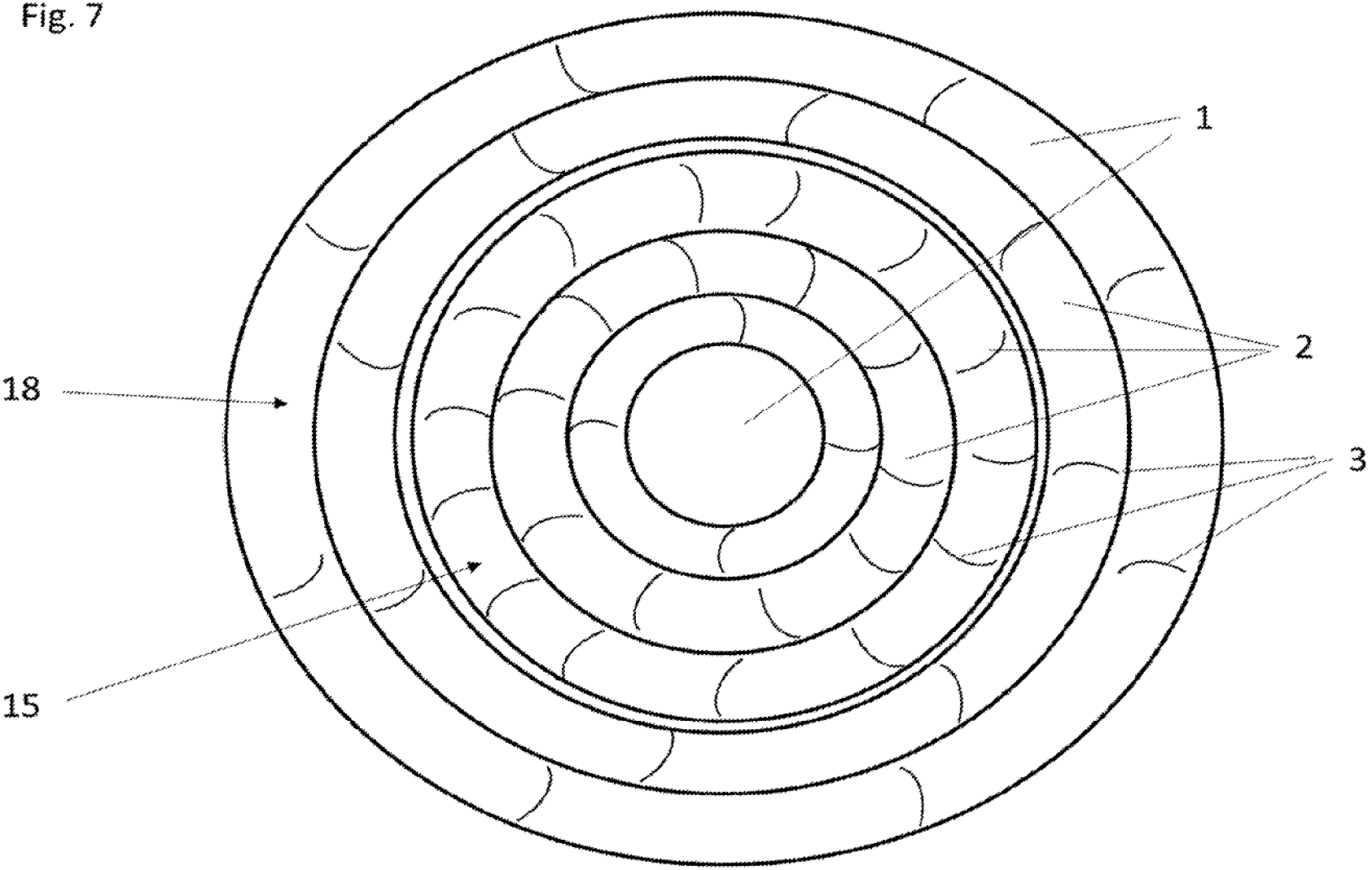
FIG. 7 shows a plan view of an impeller and a guide device with segments.

FIG. 7 shows a plan view of an impeller 15 and a guide device 18. Both the impeller 15 and the guide device 18 have a carrier unit 1, which is subdivided into annular portions 2 in each case and on which the radially curved segments 3 are arranged. The segments 3 are arranged within an annular portion 2, wherein the spacings from the annulus ends of the annular portion 2 is designed to be the same for all segments 3.

The foregoing disclosure has been set forth merely to illustrate the disclosure and is not intended to be limiting. Since modifications of the disclosed embodiments incorporating the spirit and substance of the disclosure may occur to persons skilled in the art, the disclosure should be construed to include everything within the scope of the appended claims and equivalents thereof.

The invention claimed is:

1. A centrifugal pump comprising:

a blade arrangement, wherein the blade arrangement has a carrier unit, on which blades are arranged, the blades are subdivided into segments, the carrier unit is divided into annular portions which adjoin one another radially, and the segments are arranged offset from one another in each of the annular portions, wherein an annulus width, along a radial direction of the carrier unit, for each of the annular portions is configured to be the same for all of the segments, the segments are arranged so as to overlap two annular portions and the segments are of the same length and having a rectilinear shape, and the annular portions are radially concentric relative to one another.

2. The centrifugal pump as claimed in claim 1, wherein the carrier unit has more than two, annular portions, and/or fewer than ten annular portions.

* * * * *